United States Patent [19]

Okimune

[11] 4,221,922

[45] Sep. 9, 1980

[54] WATER COOLED PANEL USED IN AN ELECTRIC FURANCE

[75] Inventor: Katutosi Okimune, Takasago, Japan

[73] Assignee: Sanyo Special Steel Co., Ltd., Hyogo, Japan

[21] Appl. No.: 958,415

[22] Filed: Nov. 7, 1978

[30] Foreign Application Priority Data

Dec. 6, 1977 [JP] Japan ..... 52-146452

[51] Int. Cl.[2] ..... F27D 1/12

[52] U.S. Cl. ..... 13/32; 110/336

[58] Field of Search ..... 13/32, 35; 432/238; 110/336

[56] References Cited

U.S. PATENT DOCUMENTS

| | | | |
|---|---|---|---|
| 3,314,668 | 4/1967 | Rosenak | 432/238 X |
| 3,843,106 | 10/1974 | Nanjyo et al. | 13/32 X |
| 3,885,082 | 5/1975 | Hanas | 13/35 |
| 3,940,552 | 2/1976 | Mizuno | 13/32 X |
| 4,097,679 | 6/1978 | Fukumoto et al. | 13/32 |
| 4,122,295 | 10/1978 | Nanjyo et al. | 13/32 |

*Primary Examiner*—Roy N. Envall, Jr.

*Attorney, Agent, or Firm*—Toren, McGeady and Stanger

[57] ABSTRACT

A water cooled panel particularly useful in an electric furnace for UHP operation, a base plate, and multiple fins, multiple steel channels, each having a specific dimensional relationship to the others.

8 Claims, 20 Drawing Figures

FIG. 1(a)
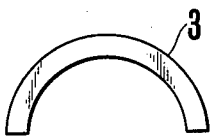
FIG. 1(b)
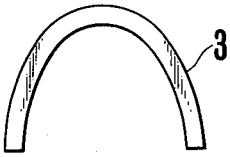
FIG. 1(c)
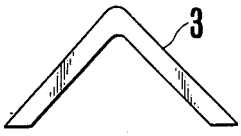
FIG. 1(d)
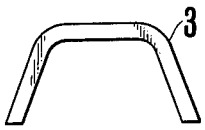
FIG.2
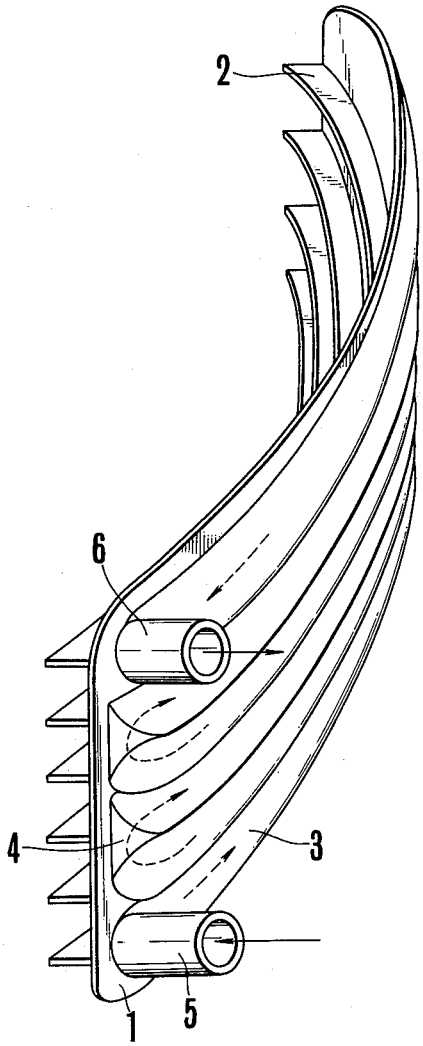
FIG. 2

WATER COOLED PANEL USED IN AN ELECTRIC FURNACE

FIELD OF THE INVENTION AND BACKGROUND OF THE INVENTION

This invention relates to a water cooled panel which provides an elongated service life, is easy for maintenance and produced at a low manufacturing cost and intended to be used in an electric arc furnace for steelmaking.

Recently, UHP operations are gaining wide acceptance in the steel manufacturing industry. They are defined as those in and electric furnace equipped with a transformer, the capacity of which is considered too large in the conventional sense relative to the melting capacity of the furnace, where heat of the arc is so piercing that the side walls tend to be extensively and severely damaged while melting proceeds rapidly. A variety of measures have been taken to protect the side walls and one of such measures is use of metallic elements in place of refractories. There are known, as typical examples, a cast iron block with cooling water conduits passing therethrough and a water cooled panel of weld fabrication with baffle plates inside to form water ways, as disclosed in U.S. Pat. Nos. 3,843,106 and 3,940,552. However, these conventional arts are confronted by certain disadvantages. The former has shortcomings of heavy weight, small cooling capacity, high manufacturing cost, etc. and the latter is susceptible to heat stress distortions due to its construction, particularly at the sides where cooling by water is also poorly effected, which leads to chances of water leakage.

This invention offers a panel, free of these drawbacks, of more safety, easy maintenance and low manufacturing cost for installation in the electric furnace.

SUMMARY OF THE INVENTION

One of the objects of the present invention is to provide a water cooled panel with fins welded on one side of a steel base plate to support self-coated slag and with multiple water flowing channels of, for instance, halved tubes welded on the other side of the plate.

The water cooled panel according to the present invention is intended to be used in the electric furnace and comprises a base plate of 6 to 30 mm thick, a length of less than $\frac{1}{8}$ width of the furnace shell circumference and smaller than $\frac{2}{3}$ the height of the side walls, multiple fins of a thickness of $\frac{1}{3}$ to 4/3 that of the base plate, horizontally placed on one side of the base plate with a spacing of 40 to 100 mm and protruding 30 to 150 mm toward the inside of the furnace, multiple steel channels of a water flowing section area of 4 to 56 $cm^2$ and a thickness of $\frac{1}{3}$ to 4/3 that of the base plate, welded horizontally side by side in principle on the other side of the base plate, to the ends of which a connecting element is welded to complete the snake-like continuous water flow from one channel to another, each end of which is equipped with the water inlet and the outlet mouth respectively and a suitable number of the fixtures welded on the same side of the water flowing channels to fasten the panel to the shell of the furnace. The weldment of the fins and that of the water flowing channels should not match in location across the base plate.

BRIEF DESCRIPTION OF THE DRAWINGS

FIG. 1 (*a*), (*b*), (*c*) and (*d*) respectively show a cross sectional view of the member forming the water flowing channels according to the present invention.

FIG. 2 is a sketch of an example of the assembled water-cooled panel according to this invention.

DETAILED DESCRIPTION OF THE INVENTION

The features of this invention will be described below referring to the attached drawings.

The essential conditions for the base plate (1) of the water cooled panel according to the present invention are that they are heat conductant and yet heat resistant on one side to stand intense arc heat and hold self-coated slag, while water cooled on the other side and also that they are rigid enough to stay in place intact in the furnace shell. The base plate is, therefore, fundamentally preferably made of a metal such as a rolled steel plate, a cast steel plate or a cast copper plate from the view points of heat load and economics. A steel plate is used in embodiments of the present invention.

The size of the base plate is basically determined by two factors; economics in manufacturing and ease in handling. A relatively small plate will be selected for installation in a special location in limited cases.

For a general purpose panel, the horizontal length is chosen as roughly $\frac{1}{8}$ to 1/24 of the circumference of the furnace shell and the height approximately as $\frac{1}{2}$ to $\frac{1}{3}$ of the side wall height. For an optimum range, the former is recommended to range from 1/16 to 1/20 and the latter about $\frac{1}{3}$ of the side wall height, because the panel of this size can be manufactured without bending the base plate to the contour of the shell.

The thickness of the plate is principally decided by (1) weldability to the water channels, (2) rigidness to hold the original shape and (3) largest possible capacity of heat conductivity. The former two conditions can be satisfied by a heavy thickness while the latter by a light wall. An elastic structure is preferred to avoid heat distortions, and therefore too heavy walls should be avoided. With these conditions taken into account 6 to 30 mm thickness is an appropriate range.

The configuration of the base plate can be arbitrarily determined in the present invention, but the most preferable one is a rectangular shape while any configuration can be manufactured to meet special requirements.

Figure 13:
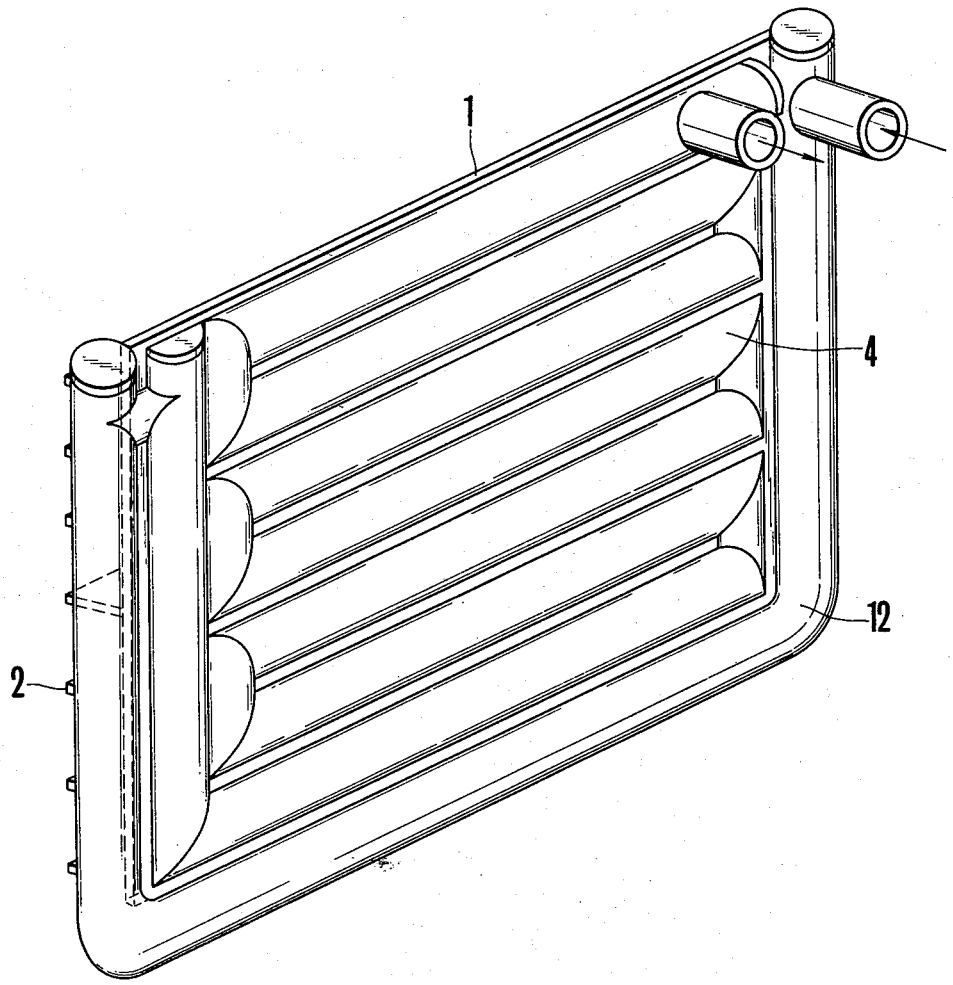
FIG. 13 and FIG. 14 are sketches of modifications of the water cooled panels according to the present invention.
Figure 14:
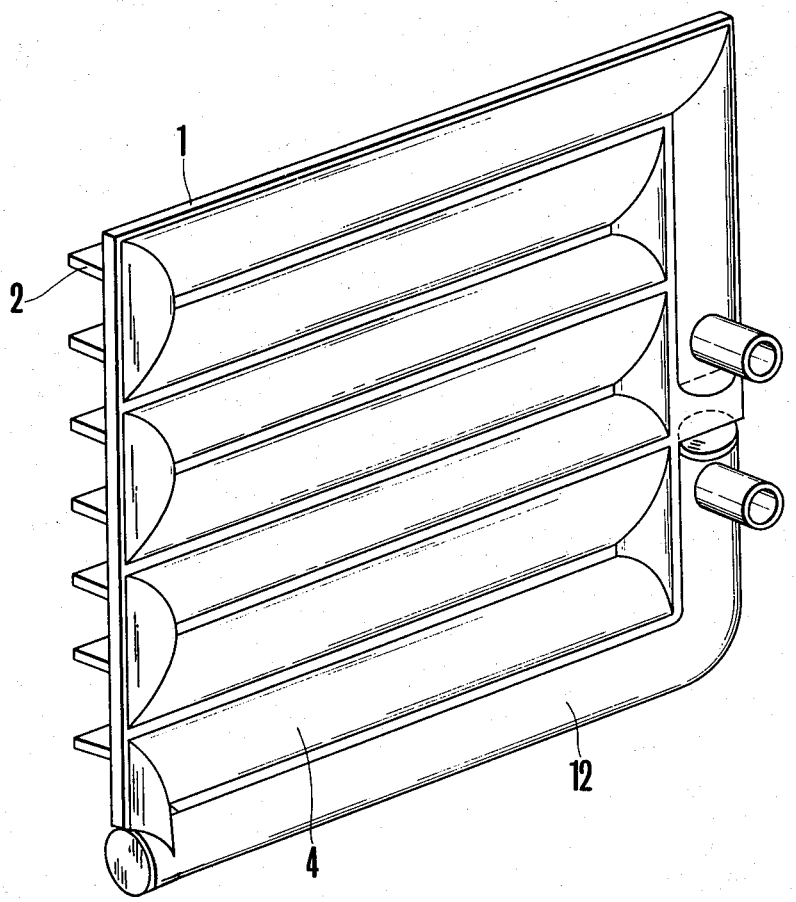

If the width of the plate is approximately 1/12 of the shell circumference, it should be bent to conform to the shell contour as shown in FIG. 2. The smaller one equivalent to less than 1/16 of the circumference need not be bent as shown in FIGS. 13 and 14.

A suitable thickness of the fin (2) is from 4/3 to $\frac{1}{3}$ of that of the base plate. Its protruding length should be at least 30 mm to support slag and its maximum practical length is considered to be 150 mm, although no upper limitation is imposed.

Figure 7:
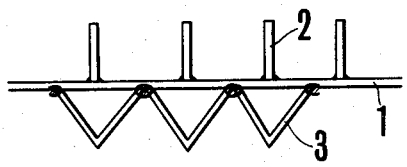
FIG. 6 and FIG. 7 show cross sectional views in part of the panels of this invention.
Figure 6:
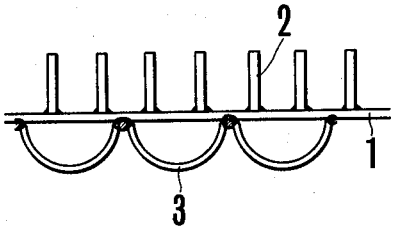

A spacing of the fins is from 30 to 150 mm, depending on the location or a variation in the heat load in the electric furnace. A smaller spacing is desirable to sustain a large amount of heat load. In this connection, as shown in FIGS. 6 and 7, care should be taken not to weld the fin immediately opposite the weldment of the water flowing channel on the other side of the base plate.

The water flowing channels which are the principal feature of this invention will be described below.

Any configuration of the channel can be, as a principle, selected, as long as water can flow through it.

It is necessary for the adjacent area between the channels on the base plate to be open outward as shown in the examples shown in FIG. 1 (*a*), (*b*), (*c*) and (*d*) in order that the multiple channels may be welded as closely as possible to the base plate.

The thickness of the water channel material must be heavy enough to be properly welded to the base plate, which should be, to be more specific, over 3 mm and $\frac{1}{3}$ to 4/3 of the thickness of the base plate at the same time.

The opening area defined by the channel and the base plate should be designed so as to assume a water velocity of 1 to 5 m/sec. so that 7 to 20 tons/hr./$m^2$ of water, which have been empirically found appropriate, can be accommodated. The area of the opening section is, for example, approximately 4 $cm^2$ for the velocity of 5 m/sec. to take 7 tons/hr./$m^2$ and approximately 56 $cm^2$ for the velocity of 1 m/sec. to take 20 tons/hr./$m^2$.

The water flowing channel is made of an arc of a sectioned tube welded to the base plate with a height from the base plate to the top of an arc corresponding to $\frac{1}{3}$ to $\frac{2}{3}$ of the diameter of a tube and with a distance on the base plate of 30–150 mm between two legs of an arc.

The channels above described are placed on the entire surface of the base plate and welded from one to another and an appropriate element is also welded to connect the adjacent opening ends with the water inlet and outlet supplied respectively at each end of the water circuit.

Figure 3:
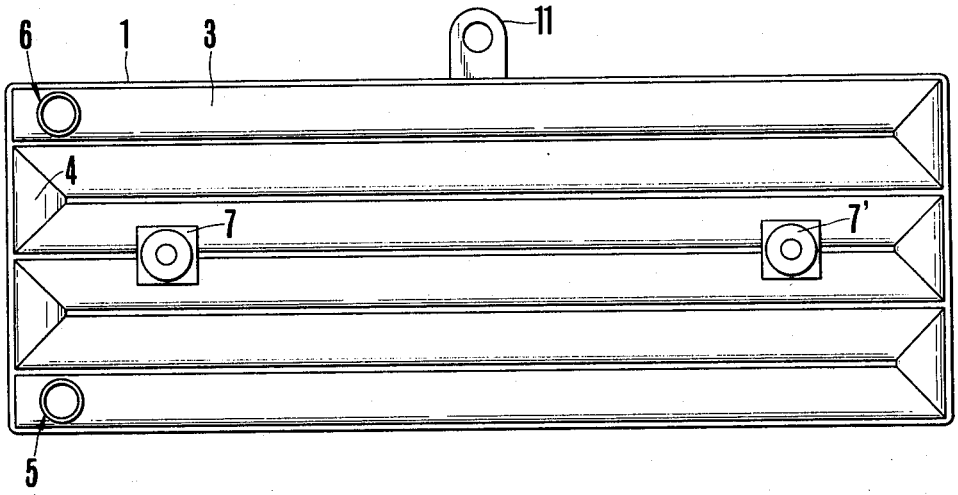
FIG. 3 is a front view of the same.
Figure 4:
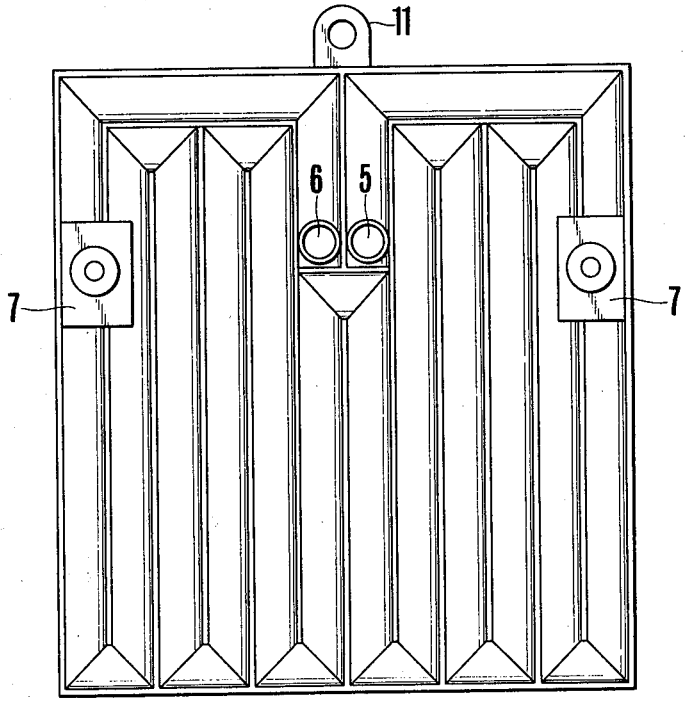
FIG. 4 is also a front view of another type of the water-cooled panel of this invention.
Figure 5A:
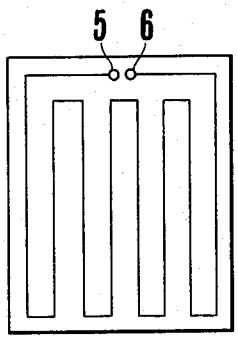
FIG. 5 (*a*), (*b*), (*c*) and (*d*) respectively show modified arrangements of the water flowing channels according to the present invention.
Figure 5B:
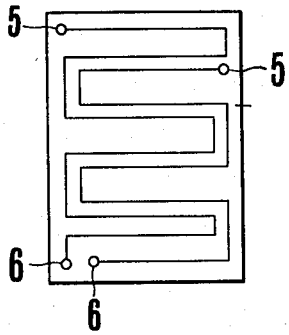
Figure 5C:
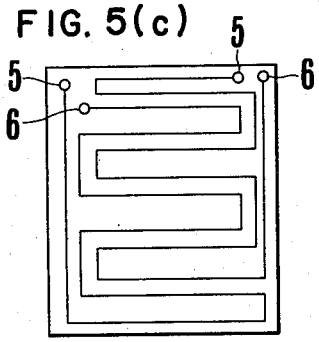
Figure 5D:
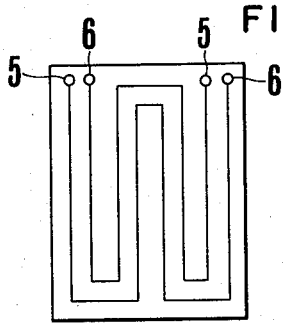

An example of the panel is shown in FIG. 2. The fixtures which are not shown in FIG. 2 are normally provided to place the panel on the electric furnace shell. FIG. 3 is a front view of the water flowing channels on one side of the panel shown in FIG. 2. In FIG. 2 and FIG. 3, 1 denotes the base plate, 2 the fin, 3 the water flowing channel, 4 the element to connect the channels, 5 the water inlet and 6 the water outlet. Furthermore, 7 in FIG. 3 is the fixture for installation in the electric furnace. FIG. 4 is a front view of another arrangement of the water channels of this invention. FIG. 5 shows a variety of water channel arrangements of this invention. FIG. 6 and FIG. 7 are examples of sections of the panels of this invention with the straight base plates.

Figure 8:
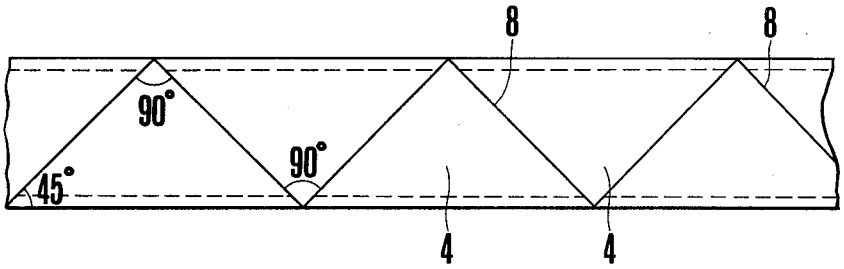
FIG. 8 is a front view of a water flow connecting halved tube used in the examples of this specification.
Figure 9:
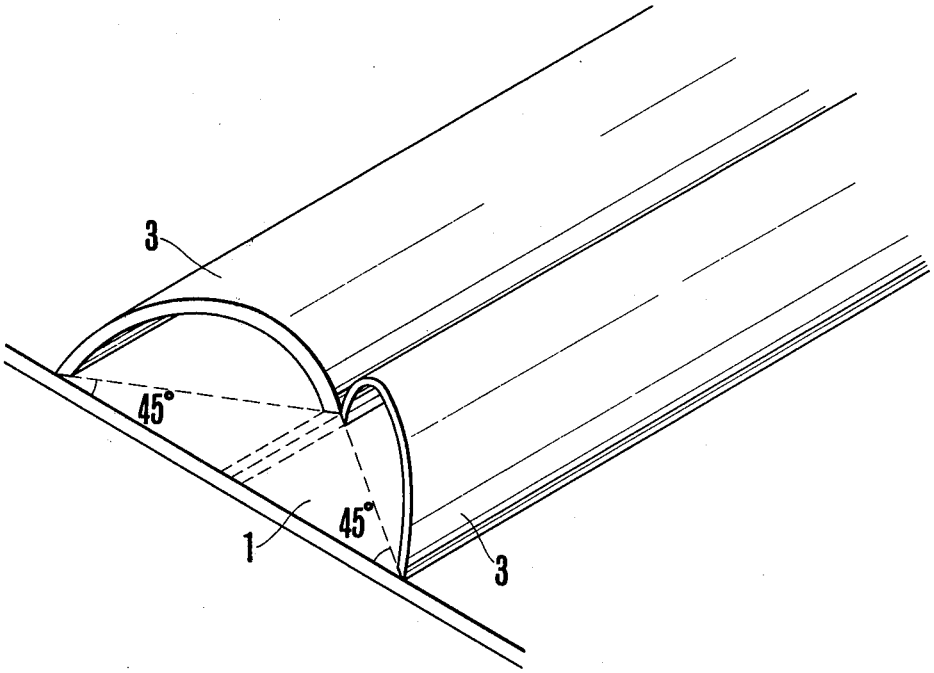
FIG. 9 shows an example of the arrangement of halved tubes on the base plate.

The connecting element of the ends of the parallel channels is cut out as shown in FIG. 8 from the same material as used for the channels. FIG. 8 is a front view of the element where the solid line 8 denotes a cutting position. The ends of the channels are beforehand cut at 45 degrees as shown in FIG. 9 to which the connecting element is welded to complete the water flow circuit. This is the simplest way of providing a continuous water flow.

Figure 10:
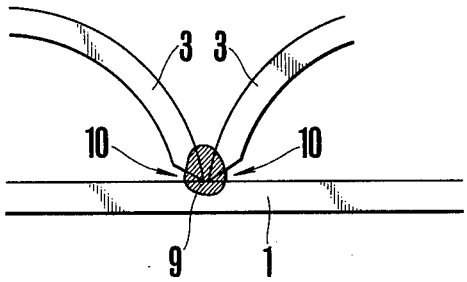
FIG. 10 is a side view of the same.

It is important for the channel and the connecting element to be chamfered inside for welding to the base plate. A hatched area, 10 in FIG. 10 shows a chamfered portion and a metal deposit. Advantages of chamfering in this manner are better cooling effects of water at this location and easier welding of the channels closely placed one another. A spacing between the channels should be larger if they are chamfered outside. Any generally practised welding method, such as arc welding or gas welding, can be adopted.

Figure 12:
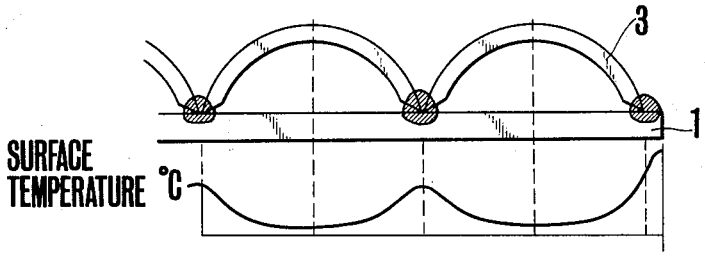
FIG. 12 is a descriptive figure of cooling effects of this invention.

According to one modification of this invention, one or more than one side of the panel may be welded by tubes. The basic invention of this invention serves well its purpose but there is no denying that the cooling effects are not so good at the side areas as in the center area as shown in FIG. 12, which shows the case where the side parallel to the channels is high in temperature. The same effects can be detected along the side perpendicular to the channels. These effects become a determining factor for the life of the panel, if it is applied in a heavily heat loaded area. The inventors have solved this proboem by welding tubes to the adversely affected side or sides. The tubes having openings similar in area to that of the channel are either connected with the water flowing channels or independent with regard to water supply and exhaust. Such an example is shown in FIG. 13 where three sides are protected by the tubes denoted 12 and integrated into the channels in regard to the water flow. FIG. 14 shows another type with a welded tube at the bottom side only.

The major features of the invented panel are:

1. Cooling effects of water are not adversely influenced by sedimentations of suspended materials in the water, because the water velocity is high enough through narrow water passages. The sedimentations are often witnessed in the box type panel or in the box type panel partitioned inside to regulate water flow.

As this panel is a so-called one plate panel, it is elastic as a whole and immune from early cracking often found in the box type panel, through heat stress concentrations in certain locations. The panel according to the present invention is, on the other hand, free from such disadvantages and much safer. It is by far superior to the box type also in respect of the manufacturing cost, i.e. approximately $\frac{3}{4}$ of that of the box type panel, and is much easier for maintenance and handling. The panel according to the present invention has another advantage that it can be manufactured to any desired configuration while conventional types of the panels are limited in their configuration.

From safety aspects, it is possible to use an extra water supply system for some period of time in an emergency when one system is out of order or forced to be closed, if there is a duplex-water supply system installed on the panel as illustrated in FIG. 5 (*b*), (*c*) and (*d*).

2. There are known various types of the water cooled panels for use in the side walls of the electric furnace, such as the cast panel enclosing the water flowing pipes or the panel comprising heaped up pipes welded together. As compared with these conventional panels, this invention pronouncedly excels them in that it is, first of all, easy in manufacturing and in handling and also carefree in inspection and maintenance during its use and furthermore can be shaped to any configuration.

The panel thus constructed is installed in a hot spot or other locations of the shell of the electric furnace and put into operation with water being circulated therethrough. Slag splashed onto the front surface of the panel is supported by the fins to form a considerably thick layer to work as a thermal and electrical insulator and also as a mechanical protective layer. The quantity of the cooling water is from 7 to 20 tons/hr./$m^2$, depending on the thermal intensity of the location in the furnace.

DESCRIPTION OF PREFERRED EMBODIMENT

A large number of the panels as shown in FIG. 2 and FIG. 3 designed and manufactured for use in the UHP furnace with an inside shell diameter of 5.8 m will be described hereinafter.

A commercially available rolled steel plate (SM 50) of 16 mm in thickness was cut to 1,710 mm wide×610 mm high and bent to the shell contour. The fins were cut to 1,710 mm wide×50 mm long to fit again to the shell contour out of a rolled steel plate (SS 41) of 12 mm thick and six of them were welded to the front side of the base plate with a spacing of 100 mm. Six tubes of 90 mm in outside diameter and of 7.6 mm in wall thickness were cut to halves and bent to the shell contour which were chamfered inside and horizontally arranged with 8 mm spacing for welding allowance and welded as shown in FIG. 3. The connecting element made out of the same tube was prepared as shown in FIG. 8 and welded to the ends of the water flowing channels. The blind plate is welded to the other ends.

The fixtures were constructed to fasten the panel to the furnace shell as shown 7 and 7' of FIG. 3 in such a way that the 110 mm-square plates were welded to a pair of two adjacent channels onto which the nuts with an outside diameter of 85 mm and threaded holes of 36 mm were welded. 11 in FIG. 3 is a hanger for transportation.

Figure 11:
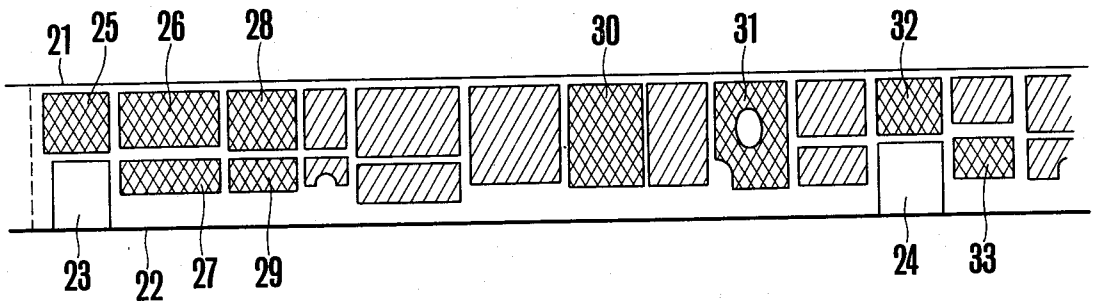
FIG. 11 is a developed drawing of the side walls in the electric furnace embedded with the panels of this invention.

The panels of various sizes were manufactured to fit in place in each location of the shell and embedded as shown in FIG. 11 of the developed side walls where 21 denotes the upper end of the side walls, 22 their lower end, 23 an operation door and 24 a side door. The double-hatched panels are in accordance with this invention and other panels are of conventional type. The area below the panels is made of refractories. 26, 28, 30 and 31 are of the basic invention; 26 being the type shown in FIG. 3, while 25, 27, 29, 32 and 33 being the modification of the basic invention, 25 and 32 being of the type shown in FIG. 13.

When all these panels were put into practical use with water circulation, the panels of this invention were coated with slag, 70 mm thick at the thickest points, 2–3 mm thick in some points at the fringes of the fins and 20–40 mm thick on an average to form the protective layers. 16 tons of cooling water were supplied to heavily thermally loaded locations and 12 tons to lightly thermally loaded areas with an average of 14 tons/hr./$m^2$. These panels operated satisfactorily for 6 months without any trouble and another 6 months after minor repair works.

What is claimed is:

1. A water cooled panel to be used in an electric furnace comprising a base plate of 6 to 30 mm thick, a length less than $\frac{1}{8}$ of the furnace shell circumference and smaller than $\frac{2}{3}$ of the height of the side walls, multiple fins of thickness of $\frac{1}{3}$ to 4/3 of that of the base plate horizontally placed on one side of the base plate with a spacing of 40 to 100 mm and protruding 30 to 150 mm toward the inside of the furnace, multiple steel channels having a water flowing area of 4 to 56 $cm^2$ and a thickness of $\frac{1}{3}$ to 4/3 of that of the base plate, welded horizontally side by side in principle on the other side of the base plate, to the ends of which a connecting element is welded to complete a snake-like continuous water flow from one channel to another both ends of which are equipped with a water inlet and an outlet mouth, and a plurality of fixtures welded on the same side of the water flowing channels to fasten the panel to the shell of the furnace, weldment of said fins and that of said water flowing channels being different in location across the base plate.

2. The water cooled panel according to claim 1 in which the water flowing channel is made of an arc of a sectioned tube welded to the base plate with a height from the base plate to the top of an arc corresponding to $\frac{1}{3}$ to $\frac{2}{3}$ of the diameter of a tube and with a distance on the base plate of 30–150 mm between two legs of an arc.

3. The water cooled panel according to claim 1 in which the water flowing channels have a polygonal cross section.

4. The water cooled panel according to claim 1 in which the water flowing channels are horizontally arranged on its base plate.

5. The water cooled panel according to claim 1 in which the water flowing channels are vertically arranged on its base plate.

6. The water cooled panel according to claim 1 in which tubes are welded to at least one side of the base plate making a complete water flow circuit.

7. The water cooled panel according to claim 1 in which the base plate is bent to the contour of the shell of the furnace.

8. The water cooled panel according to claim 1 in which the base plate is straight.

* * * * *